United States Patent [19]

Smithers

[11] 3,978,642

[45] Sept. 7, 1976

[54] METHOD AND MACHINE FOR PACKING STRIPS OF MATERIAL

[75] Inventor: James P. Smithers, Glen Ellyn, Ill.

[73] Assignee: Armour and Company, Phoenix, Ariz.

[22] Filed: Feb. 28, 1974

[21] Appl. No.: 446,588

[52] U.S. Cl. ..... 53/159; 53/123; 53/389; 198/421; 271/196; 271/DIG. 2

[51] Int. Cl.[2] ..... B65B 35/30; B65G 47/08

[58] Field of Search ..... 53/183, 157, 389, 159, 53/160, 123; 271/196, DIG. 1, 276; 198/25; 156/568

[56] References Cited

UNITED STATES PATENTS

| | | | |
|---|---|---|---|
| 2,636,654 | 4/1953 | Sykes | 53/389 |
| 2,845,763 | 8/1958 | Wonsidler | 53/157 |
| 2,882,659 | 4/1959 | Daniels | 53/389 X |
| 2,883,811 | 4/1959 | Östern | 53/123 |
| 3,001,352 | 9/1961 | Harrison | 53/389 |
| 3,470,668 | 10/1969 | Lindstrom et al. | 53/123 X |
| 3,470,674 | 10/1969 | Madonia | 53/157 |
| 3,536,560 | 10/1970 | Della Vita et al. | 156/568 X |
| 3,545,746 | 12/1970 | Ledger et al. | 271/196 |
| 3,668,821 | 6/1972 | Benson et al. | 53/389 X |

*Primary Examiner*—Travis S. McGehee
*Assistant Examiner*—Horace M. Culver
*Attorney, Agent, or Firm*—Frank T. Barber; Carl C. Batz

[57] ABSTRACT

A method of packing strips of material such as bacon by feeding a film over a roll having a cylindrical outer surface, feeding strips or slices of material onto the film over the roll and picking up the film with the strips thereon from the roll. A machine is disclosed for performing these steps in a synchronized manner. Further, there is disclosed a method of preparing food from strips of bacon or the like by heating the combination of film and food strips alternately with the food strips or the film sheet next to the grill.

3 Claims, 11 Drawing Figures

FIG. 1
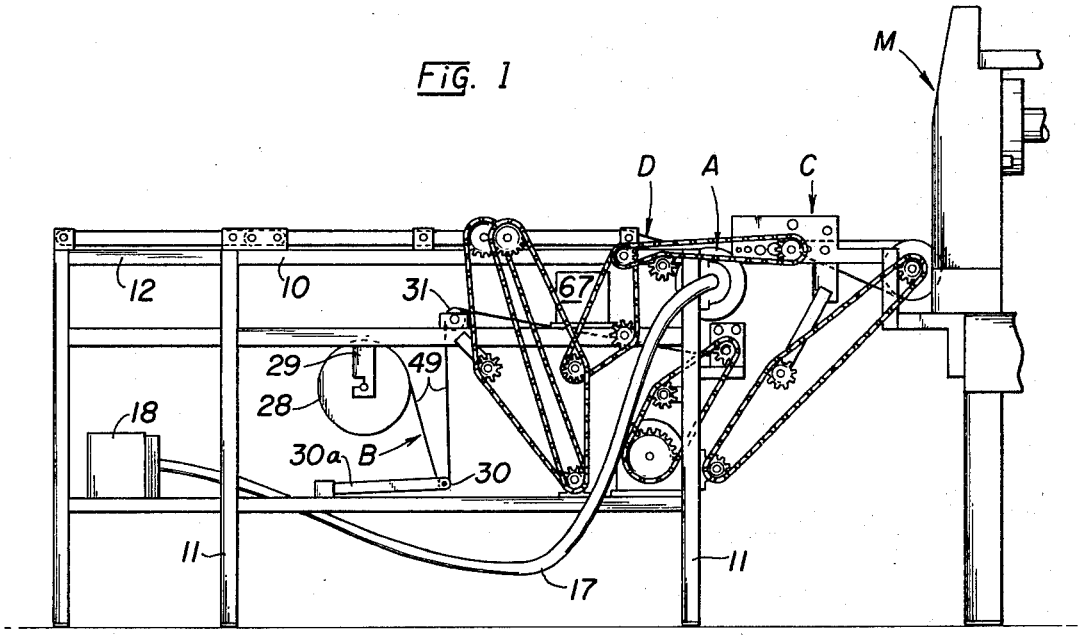
FIG. 2
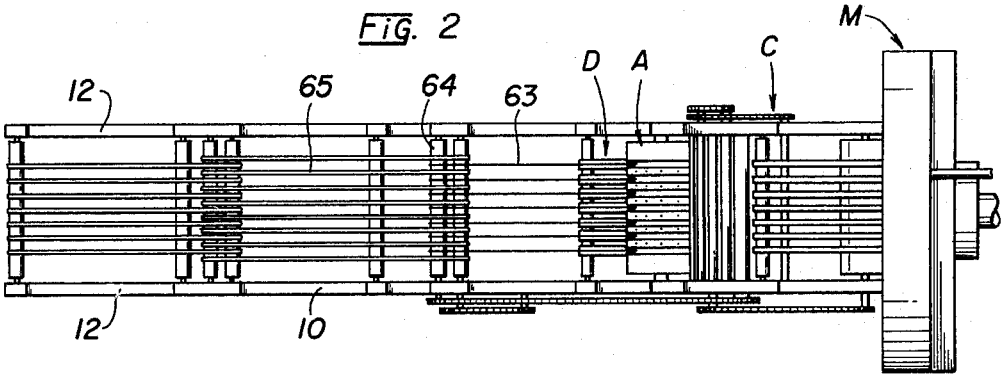
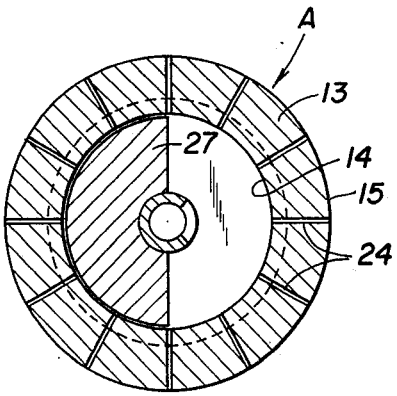
FIG. 3
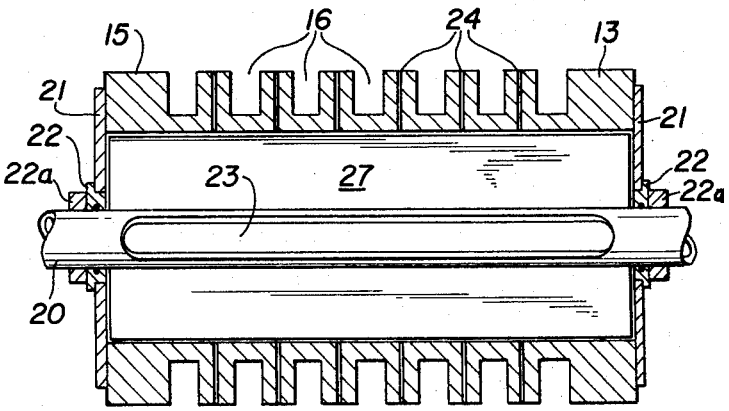
FIG. 4

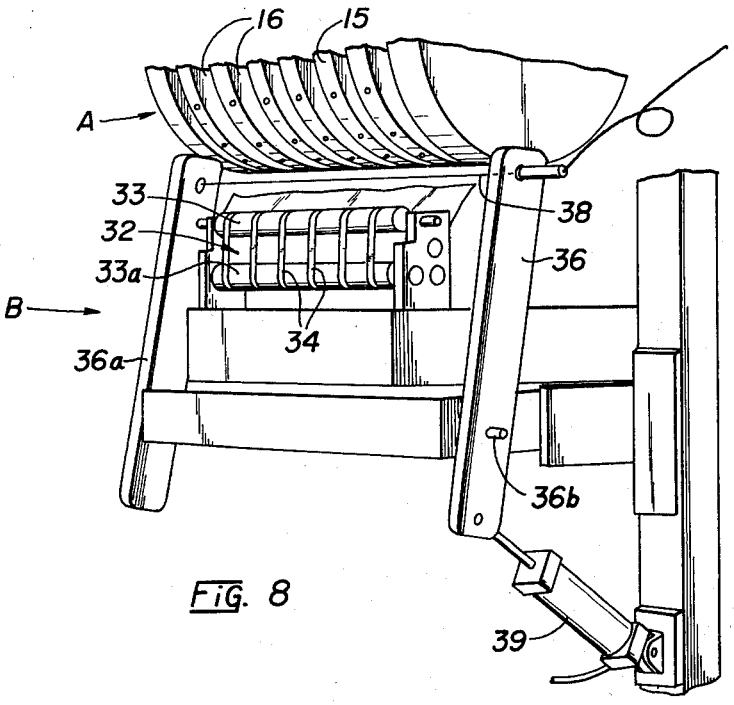
FIG. 8
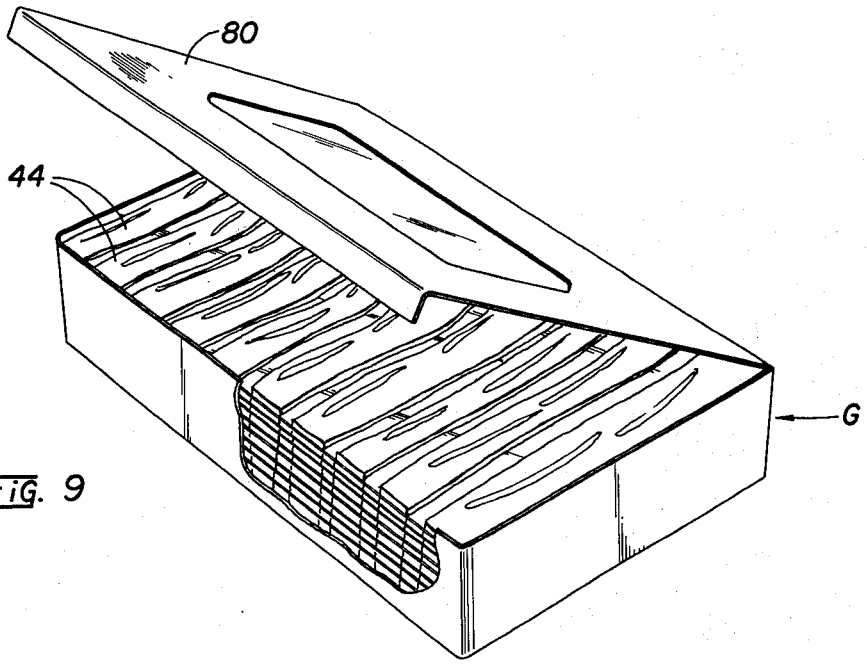
FIG. 9
FIG. 10
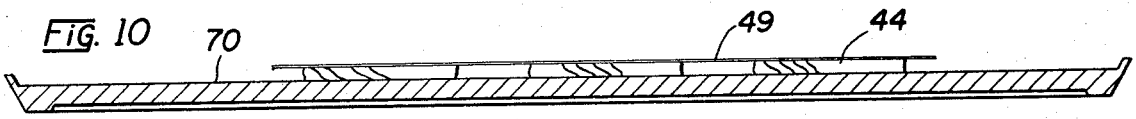
FIG. 11
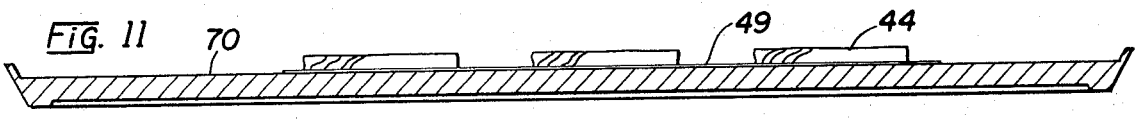

METHOD AND MACHINE FOR PACKING STRIPS OF MATERIAL

This invention relates to a method and machine for packaging strips of material such as slices of bacon in such a manner that the slices will not stick together when the packages are stored at refrigerated temperatures.

BACKGROUND

It is well known that when individual slices of bacon or the like are packed with these slices in contact with one another and the package stored at refrigerated temperatures the slices tend to stick together and are very difficult to separate without rupturing the slices. It seems that the fat on the surfaces of the bacon strips congeals and acts in the nature of an adhesive.

One way in which the art has attempted to solve this problem is to hand pack the bacon putting waxed paper between the slices so that the slices do not actually come into contact with each other. But the labor involved in such a procedure is so great that this method as heretofore suggested is not economically practicable.

Attempts have also been made to devise machines which place strips of bacon between pleated paper folds as set forth in the U.S. Pat. No. 2,817,198, but the placement of slices in individual folds of paper gives rise to difficulties. Also, in the use of bacon so packaged it is necessary to hand remove the strips of bacon from within the folds.

Another factor which makes packing of bacon or the like difficult is the speed at which the slices of bacon are being made by the slicing machines in common use in meat packing plants. It is common that the slicing machines run at speeds of the order of 300–1000 slices per minute and such speeds make more difficult the problem of accurately placing the slices in a package.

Accordingly, it is an object of this invention to provide a method and machine for packing materials such as bacon slices as they come at a rapid rate from the slicing machine, so that the slices will not be in direct contact with each other and sticking of the slices is minimized or eliminated, even when the packages are stored under refrigerated conditions. Other more specific objects will become apparent as this specification proceeds.

In my copending patent application, Ser. No. 262,656 filed June 14, 1972, and now abandoned, I describe a machine for packing items such as bacon slices in shingled relationship with a film being interleaved between the slices. The machine described in said application makes particular use of a stepped rotating roll.

SUMMARY OF THE INVENTION

I have discovered that the bacon slices may be packed by machine, not in shingled relation, but in a way such that the slices are disposed flatly on a film sheet with the trailing edge of one slice being adjacent but spaced from the leading edge of the next slice which comes from the slicer, and further that when such sheets are stacked one on another it is easy to remove a sheet at a time without sticking of the slices. Further I find that the sheet containing slices thereon may be further prepared by inverting the sheet and placing it on a grill with the bacon side next to the surface of the grill to warm the slices and that it is then easy to remove the sheet separating it from the bacon. Alternatively, the sheet may be placed on the grill with the film next to the grill and the bacon strips on top of the sheet and then applying heat through the film to cook the bacon.

DETAILED DESCRIPTION

One embodiment of the machine for accomplishing the purposes intended is illustrated in the accompanying drawings in which FIG. 1 is a view in side elevation of the improved machine;

FIG. 2 is a plan view of the machine;

FIG. 3 is a detailed cross-sectional view of the rotatable roll which forms an important part of the machine, the section being taken transverse of the axis of rotation;

FIG. 4 is a detailed cross-sectional view of the rotatable roll, the section being taken along the axis of rotation;

FIG. 8 is a detailed perspective view of the mechanism for cutting the film;

FIG. 9 is a perspective view of a carton containing the stacked bacon;

FIG. 10 is a sectional view of a griddle on which a film sheet bearing strips of bacon has been placed with the bacon strips next to the grill; and FIG. 11 is a sectional view of a griddle on which a film strip bearing strips of bacon has been placed with the film next to the grill.

Figure 5:
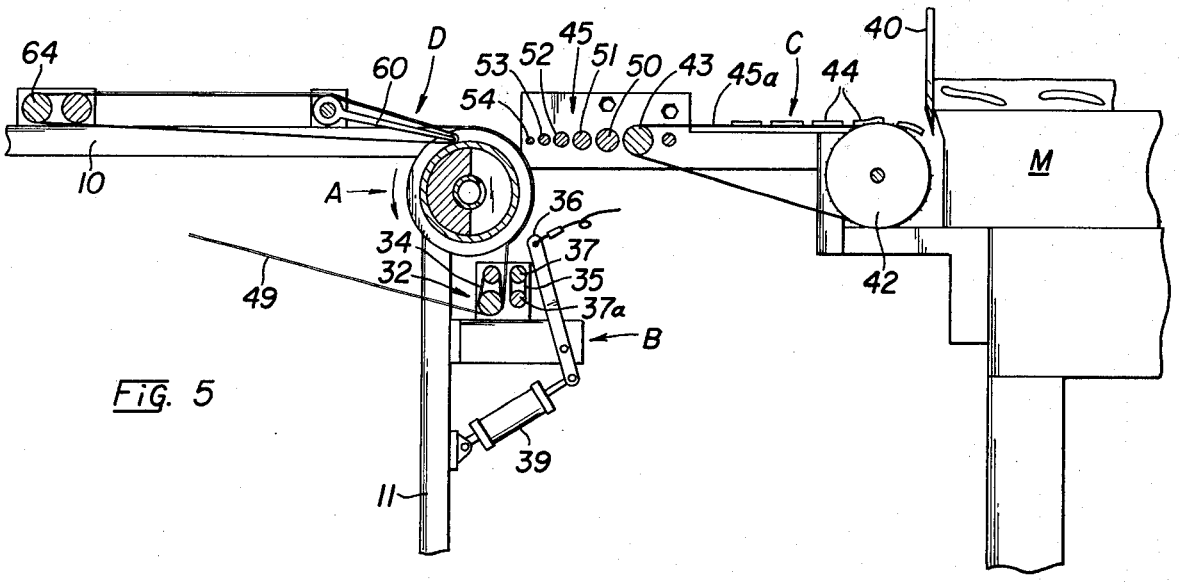
FIG. 5 is an enlarged view in elevation showing the rotatable roll, and the mechanisms for feeding this roll and for removing the strips of material from the roll.

Although the improved machine and methods may be utilized in the packing of many kinds of materials, there is particular advantage in the use of these improvements in connection with the packaging of bacon slices and in this detailed description reference will be made to the packing of bacon slices.

As illustrated, the improved machine includes a rotatable roll A, mechanism B for delivering to the roll A a flexible film and for placing this film on the outer surface of roll A, mechanism C for delivering and placing the individual bacon slices on the film while it is in place on roll A, and pick-up mechanism D for picking up and removing the film with the bacon slices thereon.

The mechanisms generally outlined above are mounted in a suitable frame 10 having legs 11 inside members 12 and are associated with the slicing machine M which may be a standard slicing machine commonly used commercially in packing houses.

The roll A may be considered the focal center of the machine. This roll is mounted transversely of the frame for rotation in a counterclockwise direction as seen in FIG. 1. Its structure is more clearly seen in FIGS. 3, 4 and 7. A principal part of this structure is the shell 13 which is hollow having the cylindrical interior surface 14. The outer surface of shell 13 may be described as cylindrical with the cylindrical surface 15 interrupted with the spaced annular channels 16 (see FIGS. 4 and 7). The portions of the surface 15 which are between the channels 16 are each cylindrical and together provide a support on which the bacon slices or other such material may be placed.

Figure 7:
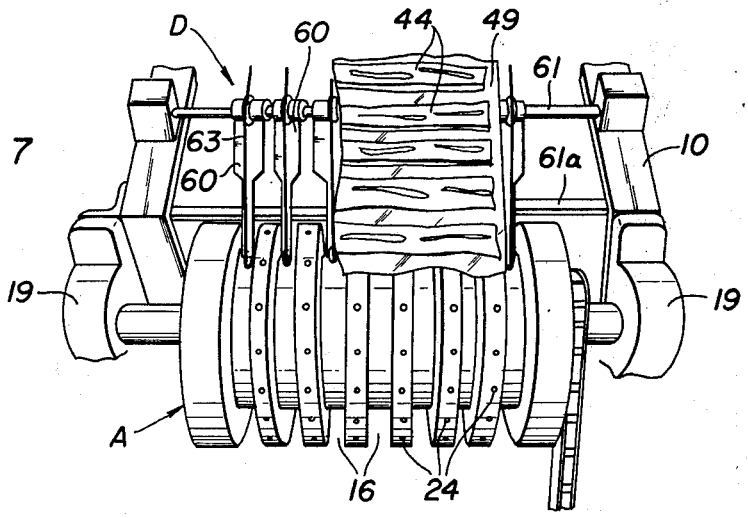
FIG. 7 is a perspective view of the rotatable roll and the mechanism for removing the bacon from the roll, the view being taken as seen from above the roll.

A pipe 20 is securely mounted in frame 10 by means of clamps 19 (FIG. 7). The shell 13 is rotatably carried on pipe 20 by means of plates 21 in which bearings 22 are contained. Retainers 22a hold the rotary member A in proper axial position.

The pipe 20 provides a conduit for the application of a vacuum to the interior of shell 13. It has an opening 23 through which air may be drawn from the interior of the shell, and angularly spaced passages 24 extend radially through the walls of the shell to areas of surface 15 on the exterior of the shell (FIGS. 3 and 4).

Within shell 13 is a half cylindrical block 27 which is secured at its axis with the pipe 20 and so remains stationary while roll A rotates. Note that block 27 is on the forward side of pipe 20 while the opening 23 connects with the rearward open area back of block 27.

The mechanisms B for delivering sheets of film material over roll A is best understood by reference to FIGS. 1 and 8. A roll 28 of film material 49 is carried on brackets 29 mounted on frame 10. The film material 49 may be paper or plastic film as is commonly used in the wrapping of meats and other products of commerce. Film from roll 28 passes under roll 30 which is carried on pivotally mounted arms 30*a* and this roll serves to keep the film taut. The film then passes over positioning roller 31 and upwardly through the feeding device 32. The device 32 includes a pair of rolls 33 and 33*a*, 33 being an upper roll and 33*a* being just below it. Each of rolls 33 and 33*a* contains spaced annular grooves in which roll the belts 34 made of rubber or suitable elastic material. Just to the rear of rolls 33 and 33*a* is a similar pair of rolls 37 and 37*a* also containing annular grooves and containing belts 35 similar to belts 34. Belts 34 and 35 are aligned and the pairs of rolls are spaced so that the film material may be passed upwardly between these pairs of rolls in a vertical plane, being gripped on both sides by the elastic belts 34 and 35. The film may move upwardly along with the belts. By moving the film material upwardly in this fashion the film can be passed onto the rotary member A without wrinkling or misalignment.

As the end of the film reaches the cylindrical outer surface 15 of roll A it is drawn tightly to this surface by vacuum drawn to pipe 20, opening 23, and passages 24. The film moves along with member A as it rotates until the film reaches the angular position where the passages contained therein are blocked by member 27 at which point the film is released from its tight connection to the roll.

Mechanism is provided for cutting off the film in sequence with the delivery of slices, and this includes a pair of side arms 36 and 36*a* (FIG. 8) pivotally mounted in the frame and arranged to swing about their pivots 36*b*. A hot wire 38 extends from the top portion of arm 36 to the top portion of arm 36*a*, and the lower end of arm 36 (below the pivot) is connected through air cylinder 39 to a frame member. When the piston of cylinder 39 is extended this moves the hot wire 38 across the film to sever the same, and when the piston of this cylinder 39 is retracted, this moves the hot wire 38 back across the film to sever it at a later time. It will be noted that the hot wire is positioned above the film feeding device 32, so that when the film is severed, the end of the film being fed from roll 28 is still held between belts 34 and 35 and is in position to be automatically fed onto roll A upon the operation of the feeding device 32.

The mechanism C, for feeding individual slices to the roll A, receives the slices from the rotary knife 40 of the slicer M (FIG. 5). As slices 44 are made by knife 40 they fall down in spaced relation on a conveyor which includes the large roll 42 having spines to help keep the strips in place and includes a smaller roll 33. Extending about rolls 42 and 43 are the bands 45a on top of which the slices pass forwardly from the slicer.

Forwardly of roll 43 is the conveyor 45 which includes a series of rolls 50, 51, 52, 53 and 54 of decreasing diameter toward the forward end of the conveyor. These rolls are preferably driven at increasing rotational speeds toward the end of the conveyor so that the linear speeds of the tops of the rolls are substantially the same. With this condition the bacon slices passing forwardly on the tops of these rolls maintain their same forward speed and spacing. This conveyor is more particularly described in my copending application Ser. No. 437;190 filed Jan. 28, 1974.

Figure 6:
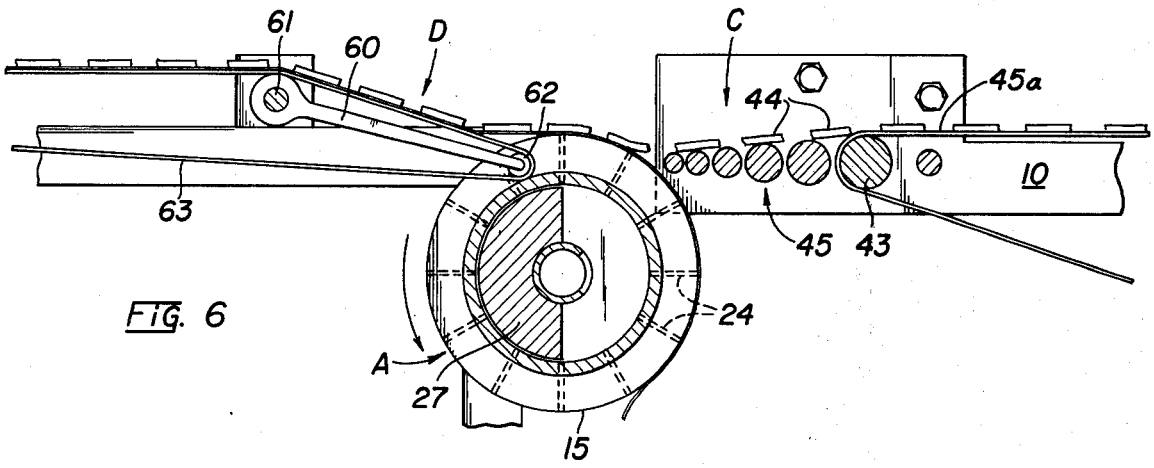
FIG. 6 is a further enlarged view in elevation of certain portions of FIG. 5 showing slices of bacon passing over the rotatable rolls.

When one of the slices 44 reaches the end of the conveyor 45 at roll 54, and the forward end of the slice extends over roll 54, this forward edge comes into contact with the film 49 on roll A, the slice passes over the film sheet, as seen more clearly in FIG. 6. The bacon slices lie on top of film 49 with their long dimensions aligned with the axis of the roll. The slices lie flat and straight. The film on which they rest is not substantially drawn into the channels 16 and effectively bridges the gap in the surface 15 caused by these channels. It may be noted that the passages 24 open not into channel 16, but at areas of the cylindrical surface between these channels. Suitably the roll A may be rotated at a speed such that its peripheral speed is substantially the same as the speed at which the slice is moved along on conveyor 45, and in this case the bacon slices will be spaced apart on the top of the film on roll A the same as it is spaced as it is passed along on rollers 50–54. As seen in FIG. 6 the bacon slices move smoothly from rolls 50–54 to the film on roll A with a minimum of turning twisting or tilting.

I find it an advantage that the roll A has a cylindrical outer surface so that there are no teeth formations or other such irregularities in this outer surface of the roll which may catch the bacon slice and turn it out of line. As a further advantage the spacing of the slices as they are placed on the film may easily be altered merely by speeding up or slowing the slicer with respect to the speed of the feeding conveyors so as to space the slices closer together or farther apart. With this arrangement it is not necessary that any teeth or steps on the roll A be moved precisely with respect to the delivery of the slices.

The mechanism D for picking up the sheets of film with slices thereon includes a set of spaced fingers 60 (see particularly FIG. 7). These fingers are pivotally mounted at their base ends on a transverse rod 61 which is secured at its ends to the frame. Fingers 60 are moveable angularly about rod 61 and rest on transverse bar 61*a* so that their ends can be accurately positioned to dip to the proper extent into the annular grooves 16 of roll A. Small pulleys 62 are provided at the ends of the fingers and the belts 63, which preferably are circular in cross-section, extend about pulleys 62 and a roll 64 which is mounted in frame 10.

The ends of fingers 60 extend under the film material and under the slices as they are delivered by roll A and as soon as the film comes into contact with belt 63 these belts take up the slices and the film on which they are resting and start to convey them forwardly. In the embodiment here shown there is a further conveyor 65 (FIG. 2) which takes the sheets with bacon slices thereon to a position still further forward. The sheets may be taken by hand from the conveyor 65 and stacked as will later be explained.

In order that the slicing machine, the roll A, the mechanism for delivering slices from the slicer to roll A, and the pick-up mechanism will work in synchronization these elements of the machine are driven from the same source. Such drive may be arranged by connecting the main shaft of the slicing machine to a gear box 67 (FIG. 1) and connecting the gear box through suitable sprocket chains and shafts with each of roll A, mechanism B for delivering the slices to roll A, and mechanism C for taking the bacon laden sheets of film off the roll A. Specific connections for accomplishing this purpose is set out in greater detail in my copending patent application, Ser. No. 262,656 filed June 14, 1972.

The device B for cutting and feeding the film is also synchronized with the slicer. The film is cut into sheets or strips and fed to roll A so that when a certain number of slices are cut (known as a draft of bacon) and these slices reach the roll A there will have been delivered to roll A by device B a sheet of film on which this draft of bacon will be placed. Specific mechanism for device B is also described in more detail in said application, Ser. No. 262,656.

In the foregoing explanation it is stated that certain rolls and conveyors are run at certain prescribed speeds and the mechanisms are driven to perform their functions in synchronization or in sequence with other functions. The drives for achieving this may be provided by having larger or smaller gears with fewer or greater number of teeth so as to accomplish the desired relative speeds, as is well understood in the mechanical arts. It is also possible that the function of feeding the film, feeding the slices to deliver them to roll A, and the picking up of the bacon laden film from roll A, be performed by hand.

OPERATION

Let us assume that the slicing machine has been started, roll A and conveyor 45 as well as the pick-up mechanism D are in operation and also that the film cutting and feeding device B is started in operation.

The bacon is sliced by the slicer blade 40 and the slices fall one after another onto the belts 45*a* on which the slices lie in transverse spaced arrangement. Moving onto the rolls 50–54 and thence to roll A. The slices move on belts 45*a* and on rolls 50–54 preferably at the same linear speeds. In the meantime a sheet of film material will have been started through the film feeding mechanism B onto roll A where it is held tightly to the surface 15 of this roll by the operation of the vacuum which draws air from areas on the surface of roll A at the mouth of passages 24 which areas are between the outer surface of the roll and the film. The air passes into passages 24, into the hollow interior of the shell 13, then into opening 23 and out through pipe 20 and tube 17 to the blower 18 or other source of vacuum.

Referring more particularly to FIG. 6, when the leading edge of the film strip passes around roll A to the point where it is aligned with the block 27 the passages become blocked so that the force of the vacuum is relieved. This vacuum continues to be relieved until the point being referred to moves angularly counterclockwise and comes to the lower edge of the block segment 27. The fingers 60 are located on the side of the roll A which has the passages blocked by the segment 27. These fingers have their ends extending within the channels 16, and the belts 63, which have their top portions moving in a forward direction serve to lift the film with the bacon slices thereon and pass it forwardly to the conveyor 65 where it may be picked up from this conveyor by hand.

The block 27 is, in the embodiment shown, in the form of a half cylinder. It is not essential that it be in the form of a half cylinder involving a 180° segment as here shown but may be a smaller segment such as a 90° or a 120° segment. This arrangement is desirably such that the slices are delivered and placed on the film over the roll A where vacuum is being drawn to secure the film to the roll, and the film with strips of bacon thereon is picked up at areas where the effect of the vacuum is blocked by member 27. The channels 16 in roll A are preferably deep enough to accomodate the whole thickness of the fingers 60 within the channel and under the surface 15 so that the lifting of the film is accomplished through contact of the top of belts 63 as the film passes forwardly. This action is illustrated more clearly in FIG. 7 of the drawings. It is further understood that after the length of film for one draft of bacon has passed the cutting wire the cylinder 39 is operated which serves to sever the sheet and when the entire sheet has been picked up the following draft may have already started in the machine to repeat the procedure.

Reference is now made to FIGS. 9, 10 and 11 of the drawings. The first draft of bacon on the first sheet of film may be placed in the rectangular box G and the next sheet and following sheets placed directly over each other as shown in FIG. 9. Suitably the strips of bacon lie directly over each other and the spaces between the slices are also aligned from bottom to top. When the box is thus filled with drafts of bacon the lid 80 may be closed and the package placed in refrigerated storage ready for marketing. A chef may simply remove the top film along with the bacon slices which it carries and proceed to prepare the bacon for consumption. FIGS. 10 and 11 illustrate alternate methods of handling the drafts of bacon. As illustrated in FIG. 10, the cook may remove a sheet with bacon slices thereon, invert the sheet, placing the bacon slices directly on the grill 70. After the bacon has become warmed the chef may easily remove the film sheet from the bacon slices and continue to cook the bacon.

Alternately, the film material may be a heat resistant film such as parchment paper, suitably a silicon treated parchment paper of about 18 to 27 pound strength or a 50 gauge polyester film such as currently marketed by the Minnesota Mining and Manufacturing Company. It is better that the film selected be tolerant of heat up to about 300°F. This means that the sheet will not be destroyed when subjected to heat sufficient to cook the bacon. When such a heat resistant film is selected and slices of bacon placed thereon as by the procedures herein described, the chef may place the sheet with bacon slices thereabove on the grill 70 as illustrated in FIG. 11, and cook the bacon by heat transmission through the heat-resistant film.

It is apparent that when bacon or the like is packed as herein described there will be no sticking of the bacon slices with each other because slices of bacon are prevented from contact one with the other by the film so that there can be no interface where congealment of fat on the food surface could seal the slices together.

While only certain embodiments of my invention have been illustrated and described in detail it is understood that the invention may take many various forms, and that all such forms are within the spirit of the invention and included in the scope of the appended claims.

I claim:

1. A machine for packing strips of material comprising a roll having a cylindrical outer surface, means for passing a film continuously upwardly and over the top of said roll with said film in contact with said roll at an area of said outer surface which area is moving forwardly and upwardly, said roll containing passages therein leading from the interior of said roll to the underside of said film, means for withdrawing air through said passages to thereby draw said film tightly to said surface at said area, means for delivering said strips onto said film over said forwardly and upwardly moving area, means for blocking said passages at an area on the surface of said roll where said passages are moving forwardly and downwardly, and means for picking up and removing said film with said strips thereon at said last mentioned area.

2. A machine for packing strips of material comprising a roll having a cylindrical outer surface, said roll containing an annular channel in said outer surface, means for passing film over said roll in conformity with said surface, conveyor means for passing said strips, one following another, onto said film over said surface of the roll whereby said strips are disposed on said film in spaced relationship with the trailing edge of one strip adjacent the forward edge of the following strip, and means extending into said channel and under said film for picking up and removing said film from said roll with said strips thereon, said pickup means including a conveyor having a belt extending into said channel.

3. A machine as set forth in claim 2 in which said pickup means includes a finger member the end of which extends into said channel and in which said belt extends about said end of said finger member.

* * * * *